US006220411B1

(12) United States Patent
Scicluna et al.

(10) Patent No.: US 6,220,411 B1
(45) Date of Patent: Apr. 24, 2001

(54) EXPANDABLE LUGGAGE

(75) Inventors: Paul Scicluna, Penndel, PA (US); David Workman, Princeton, NJ (US)

(73) Assignee: Tumi, Inc., South Plainfield, NJ (US)

( * ) Notice: Subject to any disclaimer, the term of this patent is extended or adjusted under 35 U.S.C. 154(b) by 0 days.

(21) Appl. No.: 09/433,405

(22) Filed: Nov. 3, 1999

(51) Int. Cl.[7] ..... A45C 7/00
(52) U.S. Cl. ..... 190/103; 190/105
(58) Field of Search ..... 190/103, 104, 190/105, 107

(56) References Cited

U.S. PATENT DOCUMENTS

| | | | | |
|---|---|---|---|---|
| 3,450,237 | | 6/1969 | Dyke . | |
| 4,356,899 | * | 11/1982 | Tawill | 190/103 |
| 4,773,515 | | 9/1988 | Kotkins, Jr. . | |
| 4,813,520 | * | 3/1989 | Lin | 190/107 |
| 4,953,673 | | 9/1990 | Ambasz . | |
| 5,080,206 | | 1/1992 | Tawil . | |
| 5,671,831 | | 9/1997 | Chiu . | |
| 5,749,446 | * | 5/1998 | Hsieh | 190/103 X |
| 6,021,874 | * | 2/2000 | Nykoluk | 190/103 |

* cited by examiner

*Primary Examiner*—Allan N. Shoap
*Assistant Examiner*—Tri M. Mai
(74) *Attorney, Agent, or Firm*—Baker Botts L.L.P.

(57) ABSTRACT

An item of expandable luggage includes a substantially rigid main peripheral frame and a substantially rigid secondary peripheral frame. A peripherally continuous gusset of flexible material is connected between the two peripheral frames. Opposite wall panels of the main peripheral frame are joined to corresponding opposite wall panels of the secondary peripheral frame by bridge assemblies, one such assembly being associated with each of the opposite wall panels of the respective frames. Each bridge assembly includes a pair of parallel spaced-apart slide rails affixed to the wall panel of the main peripheral frame, a substantially rigid bridge plate affixed to the wall panel of the secondary peripheral frame and slidably received by the slide rails, and a releasable latch that couples the bridge plate to the wall panel of the main peripheral frame in at least one position in which the secondary peripheral frame is held securely in a position spaced apart from the main peripheral frame.

18 Claims, 7 Drawing Sheets

EXPANDABLE LUGGAGE

BACKGROUND OF THE INVENTION

The present invention relates to luggage, especially travel luggage, and in particular to luggage that can be expanded when desired.

The needs of travelers for luggage space can vary considerably, depending on the duration of a trip, the nature of the trip in terms of the types of clothing and other gear required, and the climate of the destination. For example, regardless of the purpose and the climate, a traveler does not need as much luggage space for a trip of short duration as for a long one. Generally, a business traveler does not need as much luggage space as a recreational traveler, especially one who needs both casual and dress clothes. In most cases, men need less luggage space than women.

One way for travelers to provide for both smaller and larger luggage space requirements is to have a moderately sized suitcase for some trips and a large one for other trips. Another way is to have two moderate sized suitcases and use only one when possible and use both when a larger capacity is needed. There have also been various proposals for expandable luggage. An expandable item of luggage offers the traveler a possible savings in cost as compared to the costs of purchasing more than one piece of luggage. Moreover, the capability of expanding a piece of luggage permits a traveler to change the carrying capacity in the course of a trip. Not infrequently, a traveler will make purchases on a trip and will need more room for the return trip than for travel to a destination.

Most previously known luggage having a variable volume is of the "soft" type, such as a duffle bag with expandable sections that can be collapsed and secured to a main section. The expandable "hard" luggage that is currently available lacks rigidity when expanded due to inadequate linking of separate rigid frame components that move away from each other when the luggage is expanded.

BRIEF SUMMARY OF THE INVENTION

An object of the present invention is to provide an item of expandable luggage of the "hard" type that has a high degree of geometric stability when expanded. It is, in particular, an objective of the invention to provide a highly effective coupling between two frame components that move apart when the luggage item is expanded so that relative movements of the two frame components are minimized. A further object is to provide a hard expandable luggage item that is easily changed between a smaller volume and a larger volume.

The foregoing objects are attained, in accordance with the present invention, by an item of expandable luggage that includes a frame having a first substantially rigid component and a second substantially rigid component, each of which includes a pair of opposite rectangular planar wall panels and which together with a pair of wall members form the peripheral boundary of a variable volume receptacle and a rectangular area. A peripherally continuous gusset of flexible material is connected between the wall panels and wall members of the two frame components and provides, when the luggage item is expanded, a portion of the peripheral wall of the receptacle. A bridge assembly joins each wall panel of the first component to a corresponding wall panel of the second component in coplanar relation and for linear displacement of the two components toward and away from each other. Each bridge assembly includes a pair of parallel spaced-apart slide rails affixed to the wall panel of the first component, a substantially rigid bridge plate affixed to the wall panel of the second component and slidably received by the slide rails, and a releasable latch that couples the bridge plate to the wall panel of the first component in at least one position in which the second component is held securely in a position spaced apart from the first component.

The bridge plate/slide rail arrangement provides high rigidity to the luggage item in the expanded state. Forces tending to displace the frame components in the planes of each of the bridge plates and the wall panels with which the bridge plates are associated are transmitted from the second frame component to the bridge plate and from the bridge plate through the slides to the first component. The spacing of the slide rails and the corresponding length of the bridge plate between the slide rails provide considerable strength and stiffness that resists relative displacements of the components and maintains both the coplanar relationships of all of the peripheral wall panels and a parallel relationship between the two frame components. The bridge plate/slide rail arrangement, in other words, maintains stability of the frame system in both the collapsed and expanded states against displacement in mutually perpendicular directions in a plane perpendicular to the planes of the peripheral walls of the frame components, against skewing of one component relative to the other about any axis perpendicular to that plane, and tilting of one component relative to the other about any line in that plane. The latch holds the two frame components rigidly at the predetermined spacing in the expanded state so that the luggage item cannot collapse under loads imposed on it.

Various latches are possible. For example, the latch may permit the bridge plate to be latched to the wall panel of the first component in a plurality of positions, and even in an infinite number of positions. Infinite latch positions are provided in a simple and effective way by a panel of loop material affixed to the bridge panel, a flexible band attached to the wall panel of the first component, and a strip of hook material affixed to the flexible band and releasably engageable with the loop material on the bridge plate.

Other forms of latches may include one based on a cam cutout in the bridge plate and a cam disc carried for rotation by the wall panel of the first component and one composed of a resiliently biased catch button carried by the wall panel of the first component and an abutment edge on the bridge plate engageable by the catch button.

In a desirable configuration, each slide rail includes a body portion engaging the wall panel of the first component and a projecting flange portion defining with the wall panel of the first component a guide groove. The bridge panel in that configuration resides in engagement with the wall panel with which it is associated and gains stiffness from such engagement—the co-engaging portions of the bridge plate and the wall panel are linked along the slide rails and provide a stiff "unit" that resists bending perpendicular to the plane of the wall panel. Similarly, the bridge plate is fastened to the wall panel of the second frame component and gains support and stiffness from such attachment, again enhancing the rigidity of the bridge assembly.

It is desirable for the flange portion of each slide rail to have a guide rib projecting toward the wall panel of the first component. In that case, the bridge plate has along opposite edges a guide groove receiving the guide rib on the flange portion of the slide rail. The rib and groove guiding relationship stiffens both the slide rail and the edges of the bridge plate.

DESCRIPTION OF THE DRAWINGS

For a more complete understanding of the present invention, and the advantages thereof, reference may be made to the following written description of an exemplary embodiment, taken in conjunction with the accompanying drawings.

DESCRIPTION OF THE EMBODIMENT

Figure 1:
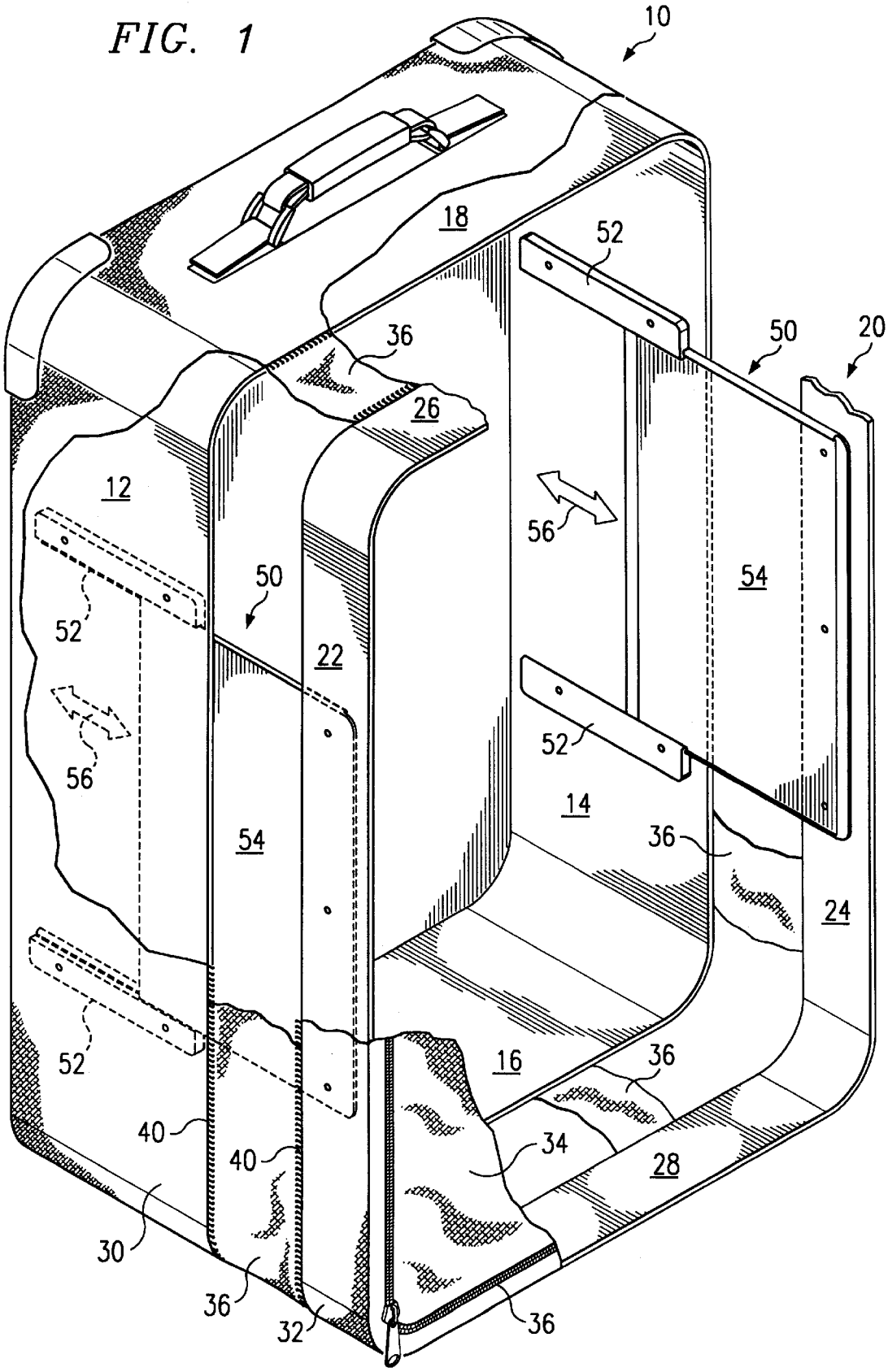
FIG. 1 is a generally schematic three-quarter front pictorial view of the embodiment, with portions broken away.
Figure 2:
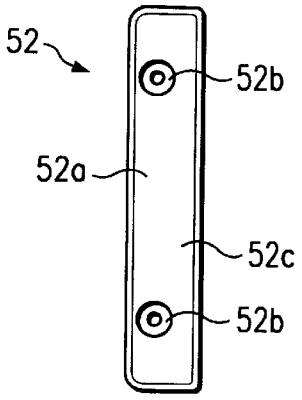
FIG. 2 is a front elevational view of a slide rail.
Figure 3:
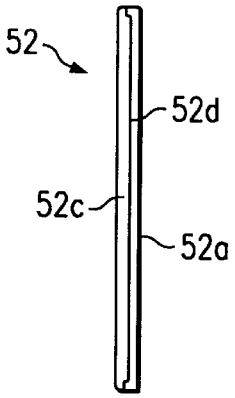
FIG. 3 is a side elevational view of the slide rail.
Figure 4:
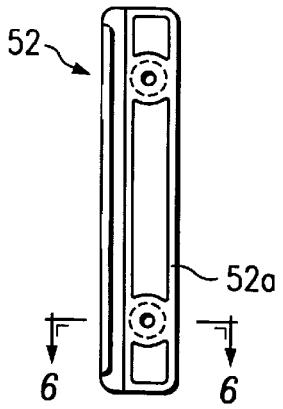
FIG. 4 is a rear elevational view of the slide rail.
Figure 5:
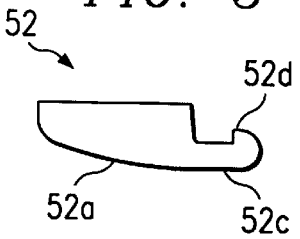
FIG. 5 is an end elevational view of the slide rail.
Figure 6:
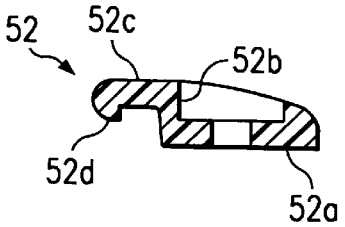
FIG. 6 is an end cross-sectional view of the slide rail taken along the lines 6—6 of FIG. 4.
Figure 7:
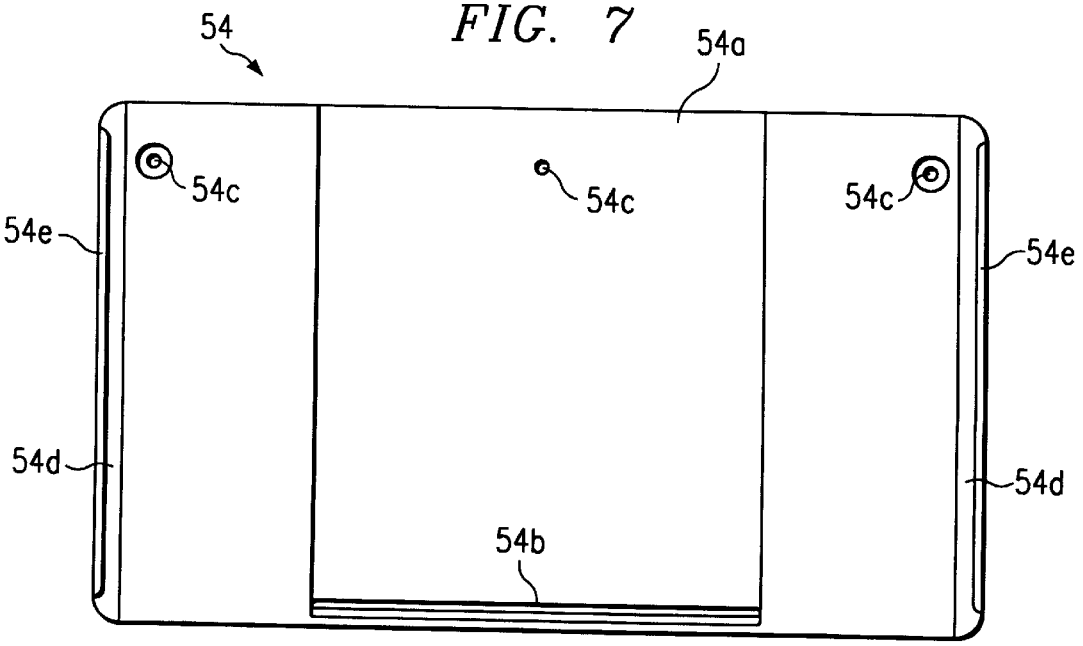
FIG. 7 is a front elevational view of a bridge plate.
Figure 8:
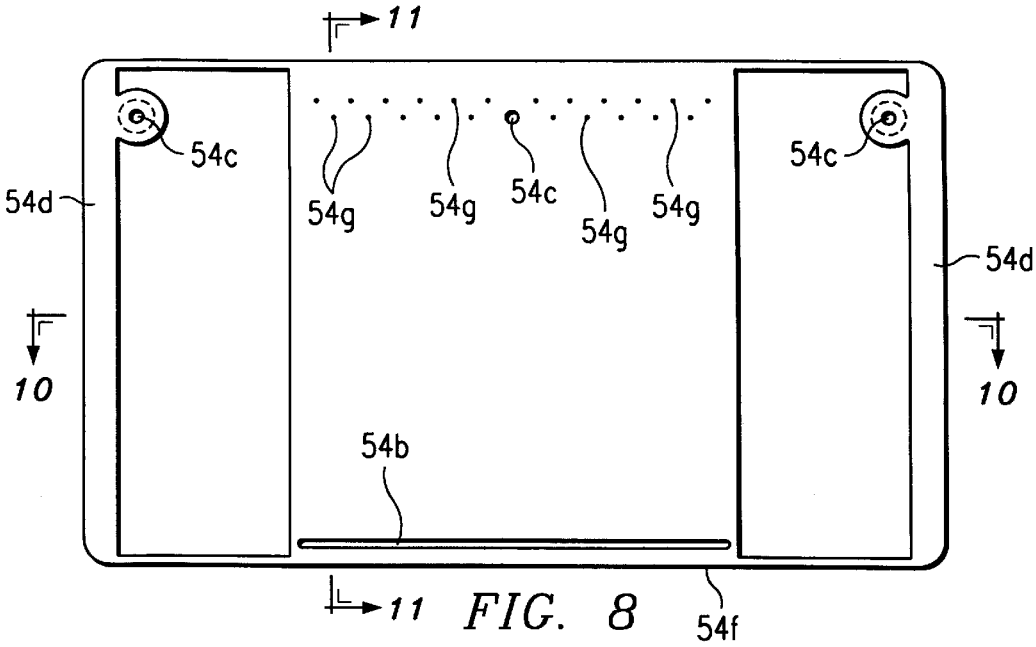
FIG. 8 is a rear elevational view of the bridge plate.
Figure 9:
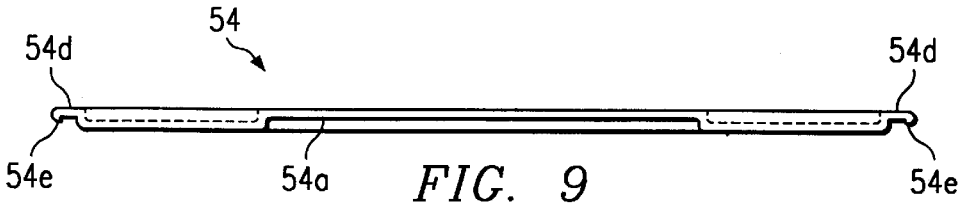
FIG. 9 is a view of the top edge of the bridge plate.
Figure 10:
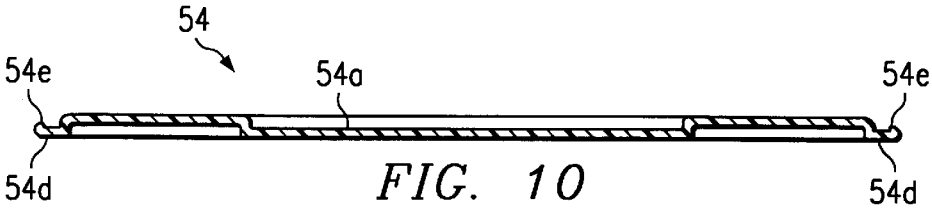
FIG. 10 is a cross-sectional view of the bridge plate taken along the lines 10—10 of FIG. 8.
Figure 11:
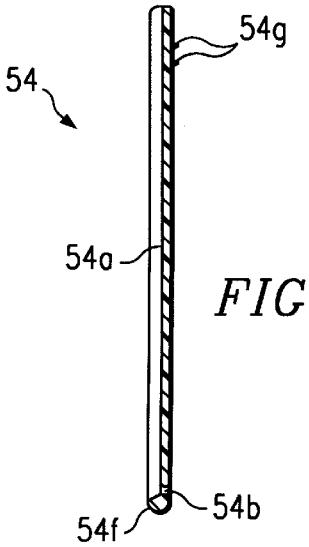
FIG. 11 is a cross-sectional view of the bridge plate taken along the lines 11—11 of FIG. 8.

The embodiment shown in FIG. 1 has a two-component frame, which may be of any suitable specific construction in terms of materials, manner of assembly, and configurations of the parts. A main frame component 10 has a pair of rectangular planar side wall panels 12 and 14, a bottom wall member 16 and a top wall member 18, which are substantially rigid and rigidly connected at the corners. Although the drawing shows the bottom and top members as panels, most travel luggage being marketed currently is of the towable, wheeled type. In practice for such luggage items, the bottom member and top member of the main frame are configured to accept wheels, a towing handle, a carrying handle, and the like. The main frame component 10 may also have a partial or complete rigid back wall panel. A secondary frame component 20 is formed of opposite rectangular planar panels 22 and 24 and top and bottom members 26 and 28, which as a practical matter will usually also be rectangular planar panels of sheet material.

The main frame component 10 receives a cover 30 of a durable fabric. The sides, top and bottom of the secondary frame receive a fabric cover 32. Access to the interior of the luggage item is through a front opening that is closed by a panel 34, is joined to the cover 32 at the bottom edge and can be opened and closed by undoing and doing up a zipper 36 along three sides.

The main part (main frame 10 and its cover 30) of the luggage item is joined to the secondary part (secondary frame 20 and its cover 32, 34) by a gusset 36 of a durable, flexible material that extends along the entire perimeter of the luggage item (along the top, bottom and both side walls). In the expanded state of the item, the gusset 36 peripherally bounds that part of the entire volume of the main compartment by which the volume of the item is increased upon movement of the secondary unit away from the main unit. In the retracted (smaller volume) state (not shown) of the luggage item, a zipper 40 that extends about the entire perimeter of the item is done up. The gusset 36 folds into the interior of the item.

The main frame component 10 is joined to the secondary frame component 20 by two identical bridge assemblies 50, one of which is associated with the side panels 12 and 22 and the other with the side panels 14 and 24. Each assembly consists of a pair of parallel spaced-apart slide rails 52 that are affixed to the wall panel 12, 14 of the main frame component 10, a substantially rigid bridge plate 54 that is affixed to the wall panel 22, 24 of the secondary frame component 20 and is slidably received by the slide rails 52, and a latch 56 (shown schematically as an arrow in FIG. 1) that releasably connects the bridge plate 54 to the wall panel 12, 14 of the main frame component 10 in at least one position in which the secondary frame component 20 is held spaced apart from the main frame component 10, thereby to retain the luggage item in the expanded state.

A suitable slide rail 52, as shown in FIGS. 2 to 6, is injection molded from a durable polymeric material and has a body portion 52*a* with countersunk holes 52*b* for screws or rivets by which it is fastened to the wall panel 12, 14 and a flange portion 52*c* with a rib 52*d*. The underside of the body portion 52*a* bears against the surface of the panel 12, 14 (or a fabric liner within the luggage item). The flange portion 52*c* forms with the wall panel 12, 14 a guide groove that accepts the edge of the panel in sliding/guiding relation.

Figure 12:
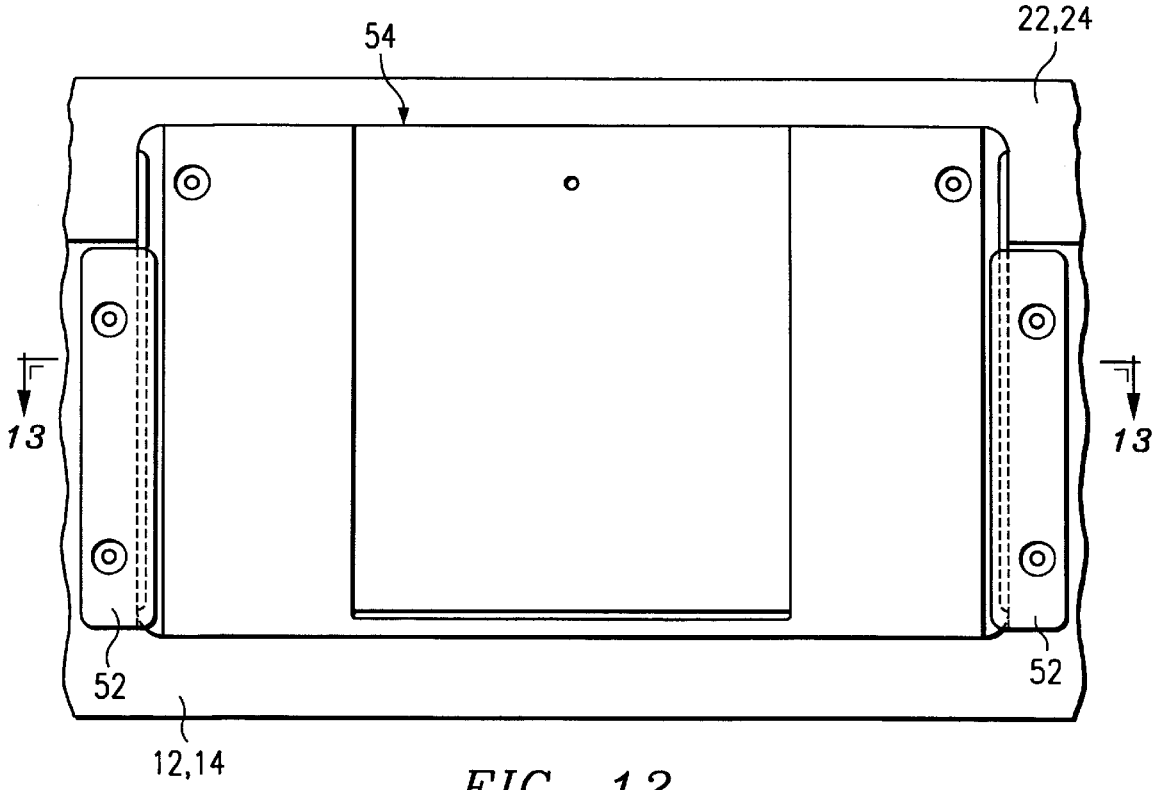
FIG. 12 is a front elevational view of the bridge plate and slide rails assembled.
Figure 13:
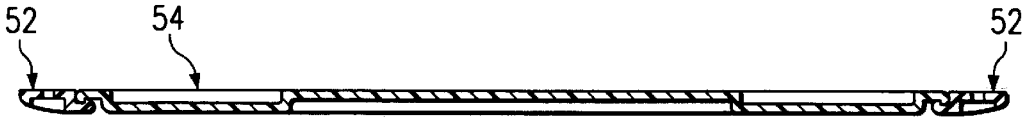
FIG. 13 is a cross-sectional view of the assembled bridge plate and slide rail taken along the lines 13—13 of FIG. 12.

A suitable bridge panel 54, as shown in FIGS. 7 to 11, is injection molded from a durable polymeric material and has a recess 54*a* on the side facing into the interior of the luggage item, a slot 54*b* adjacent one edge, holes 54*c* for screws or rivets by which it is fastened to the wall panels 22, 24 of the secondary frame component 20, and edge flanges 54*d* with ribs 54*e* along each side edge. The bottom edge 54*f* is smoothly rounded. Rows of tiny fabric anchor pins 54*g* protrude from the back surface near the upper edge. The guiding/sliding relationship between the slide rails 52 and bridge plate is shown in FIGS. 12 and 13.

Figure 14:
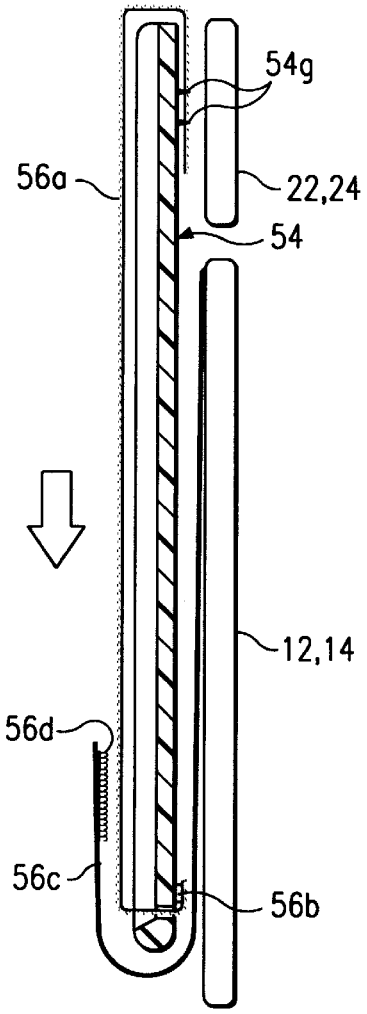
FIG. 14 is a generally schematic view of a side edge of a bridge assembly and latch having the slide rails and bridge plate of FIGS. 2 to 13, showing the assembly in the retracted position of the luggage item.
Figure 15:
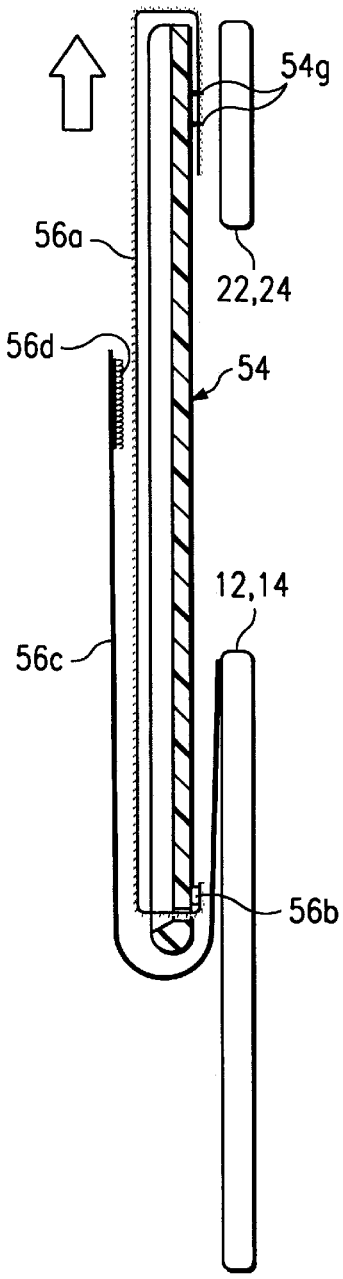
FIG. 15 is a generally schematic view of a side edge of a bridge assembly and latch having the slide rails and bridge plate of FIGS. 2 to 13, showing the assembly in the expanded position of the luggage item.

Many forms of latch can be used to releasably connect the bridge plate to the main frame wall panels 12, 14 in the expanded state of the luggage item. The bridge plate 54 of FIGS. 7 to 11 is designed for the latch 56 shown in FIGS. 14 and 15, the showing being schematic for greater clarity. A piece 56*a* of a loop material, such as "VELMAT," is hemmed along one end to form a bead 45*b*, inserted through the slot 54*b* in the bridge panel 54, trained along the front of the bridge panel and folded over the top of the bridge panel. When the bridge panel 54 is fastened to the wall panel 22, 24, the loop piece 54*a* is clamped in place; the hem/bead holds the lower edge, and the clamping, along with the tiny pins 54*g*, holds the upper edge. The loop piece 56*a* is received in the recess 54*a* of the bridge panel 54.

A piece 56*c* of smooth strong flexible material is suitably fastened to the main wall panel 12, 14 near the edge closer to the secondary wall panel 22, 24, turned around the rounded bottom edge 54*f* of the bridge panel and guided freely along the front face of the bridge panel. A strip 56*d* of hook cloth stitched to the free end of the piece 56*c* is releasably anchored to the loop piece 56*a* at any desired location by the mutual tenacity of the loop and hook materials. The user may easily and quickly adjust the luggage item to any of an infinite number of volumes within the range of the smallest volume with the zipper 40 done up to the largest with the zipper 40 undone and the gusset 36 fully extended by grasping the ends of the pieces 56*c* of both bridge assemblies 50 and pulling them toward the open front of the item. Pulling on the pieces 56*c* draws the pieces 56*c* around the lower edge 54*f* of the bride panel 54 and moves the secondary frame 20 away from the main frame. At any desired point of movement, the user may anchor the hook strips 56*d* to the loop piece 56*a,* thereby setting the volume of the luggage item to the directed size.

In all positions of the latch assembly, and especially at the largest volume, the bridge assembly stabilizes the shape of the luggage item by preventing up and down movements, side to side movements, rotational skewing movements, and side to side and front to back cocking movements of the secondary unit relative to the main unit. More simply put, the sliding support of the bridge plate 54 by the slide rails 52 holds the secondary unit stationary laterally, longitudinally and rotationally relative to the main unit in the plane of the rear edge of the secondary frame and maintains the plane of the rear edge of the secondary unit parallel to the plane of the front edge of the main unit. The latch 56 keeps the luggage item from collapsing. If the luggage item is adjusted to less than the maximum volume, the latch does not preclude movement of the secondary unit to the maximum volume position. Such movement is not of concern. The purpose of the latch is to maintain a desired minimum volume in an expanded state for the convenience of the user when he or she is packing the luggage and to avoid crushing the contents when the luggage is handled or stowed for transport.

Figure 17:
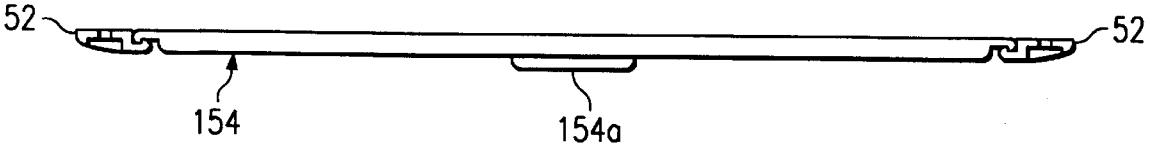
FIG. 17 is a view of the top edge of the bridge assembly of FIG. 16.
Figure 16:
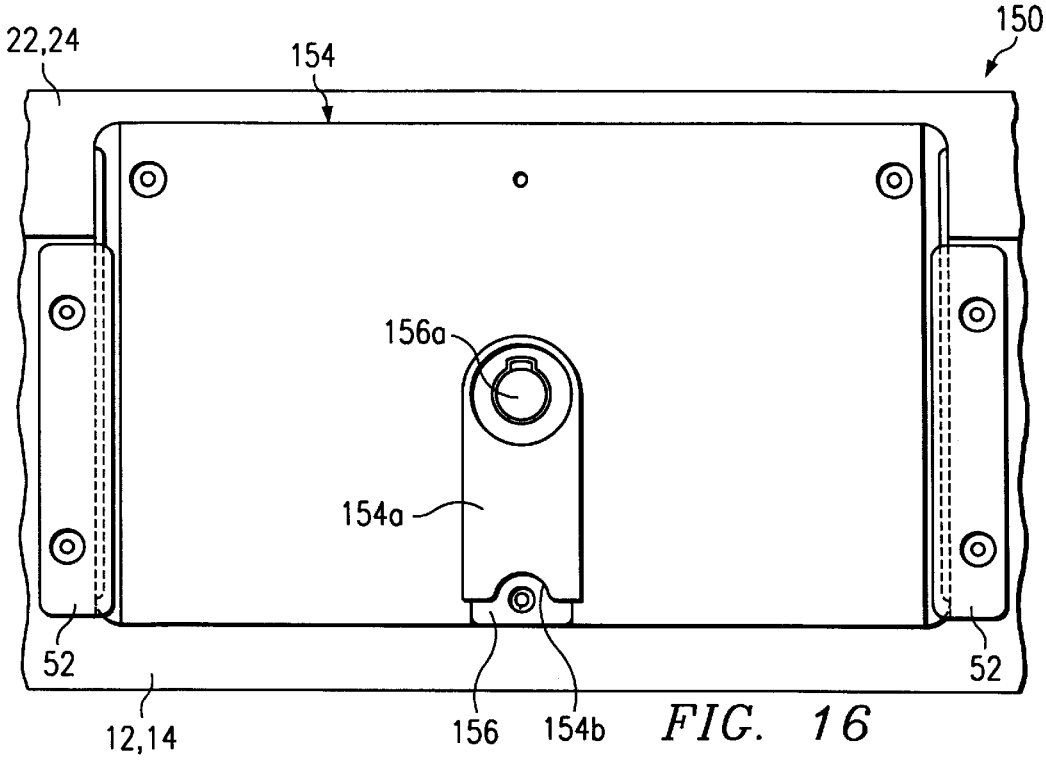
FIG. 16 is a front plan view of another bridge assembly useful for the present invention, showing the assembly in the retracted position of the luggage item.
Figure 18:
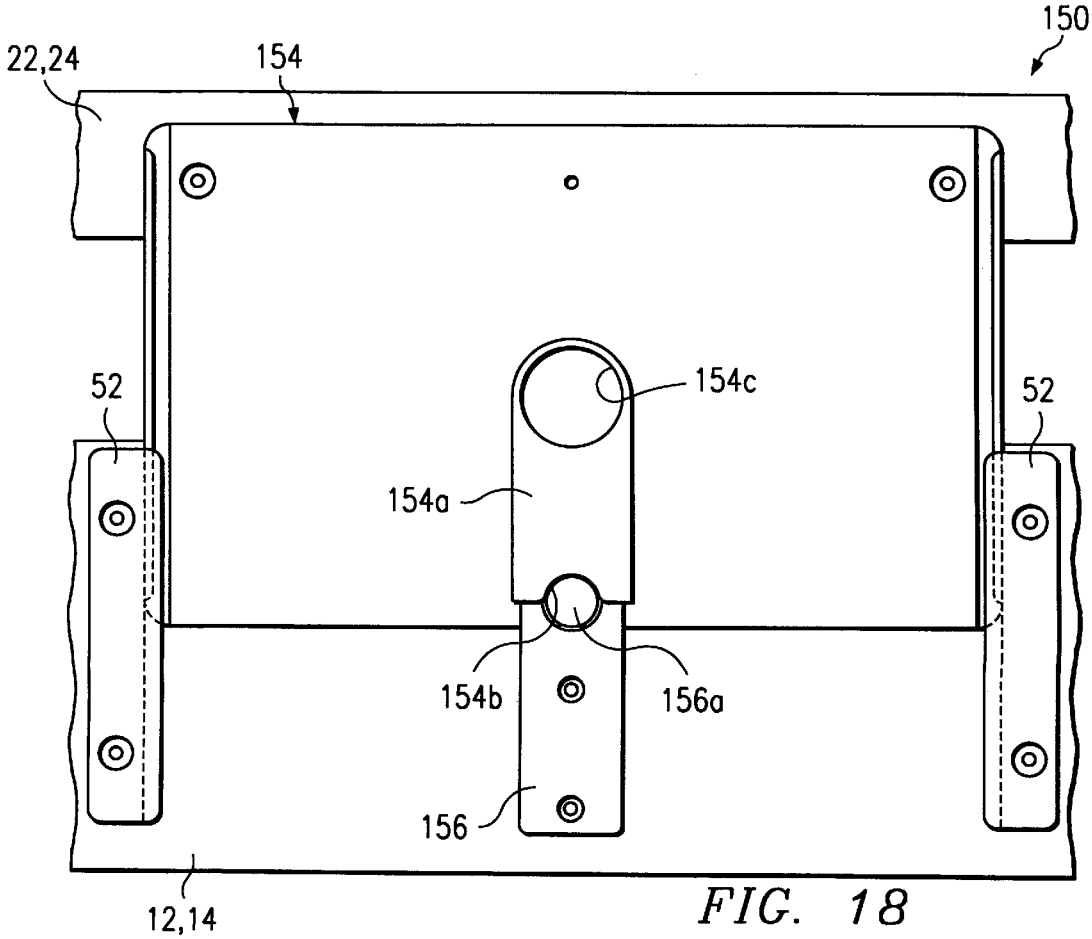
FIG. 18 is a front plan view of the bridge assembly of FIGS. 16 and 17, showing it in the expanded state.

Another bridge assembly 150, as shown in FIGS. 16 to 18, has a slightly modified bridge plate 154 and a push-button catch unit 156. The bridge plate 154 has a recess (not shown per se but apparent from the front as a protuberance 154*a*) in the rear surface that accepts the catch unit 156 in the retracted state (FIG. 16). A push button 156*a* of the catch unit is resiliently biased relative to the casing 156*b* of the catch unit such that in the expanded state of the luggage item it engages a rounded edge 154*b* of the bridge panel at the lower edge of the recess/protuberance 156*a,* thus latching the luggage item in the expanded state (FIG. 18). The front face of the push button is tapered so that when the user pulls the secondary unit away from the main unit from the retracted position, the lower edge of a hole 154*c* in the recess/protuberance 154*a* cams the push button against its resiliency, so the user does not have to push the push buttons to expand the luggage item. Pushing in on the release button 156*a* disengages the button from the shoulder 154*b,* allowing the luggage item to be restored from the expanded state (FIG. 18) to the retracted state (FIG. 16).

Figure 19:
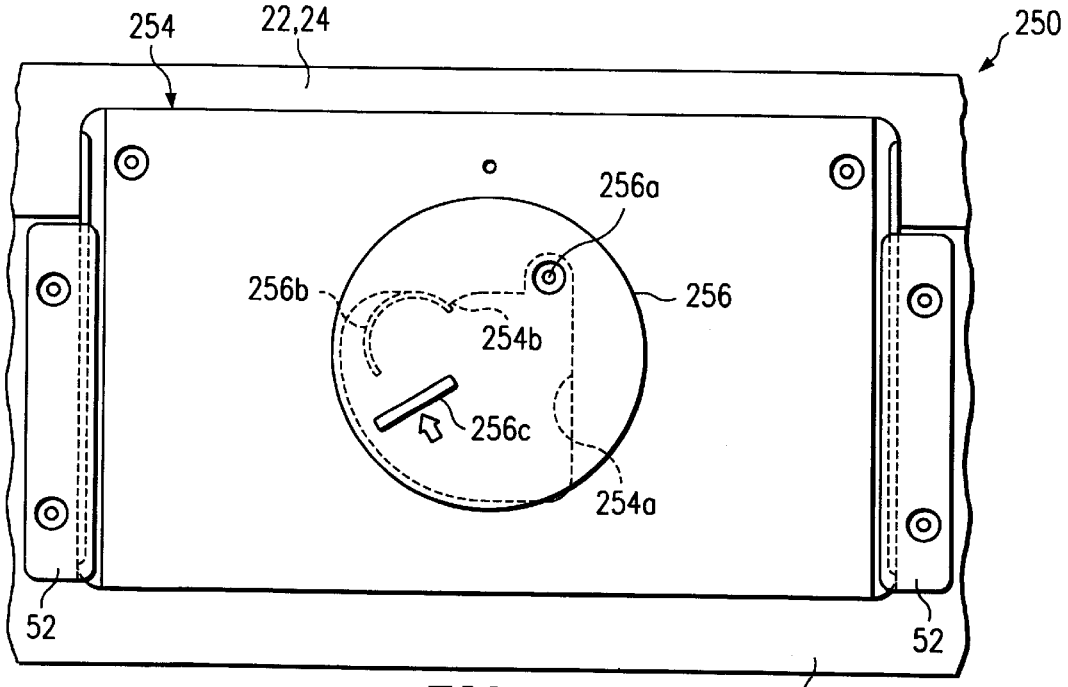
FIG. 19 is a front plan view of yet another bridge assembly useful for the present invention, showing the assembly in the retracted position of the luggage item.
Figure 20:
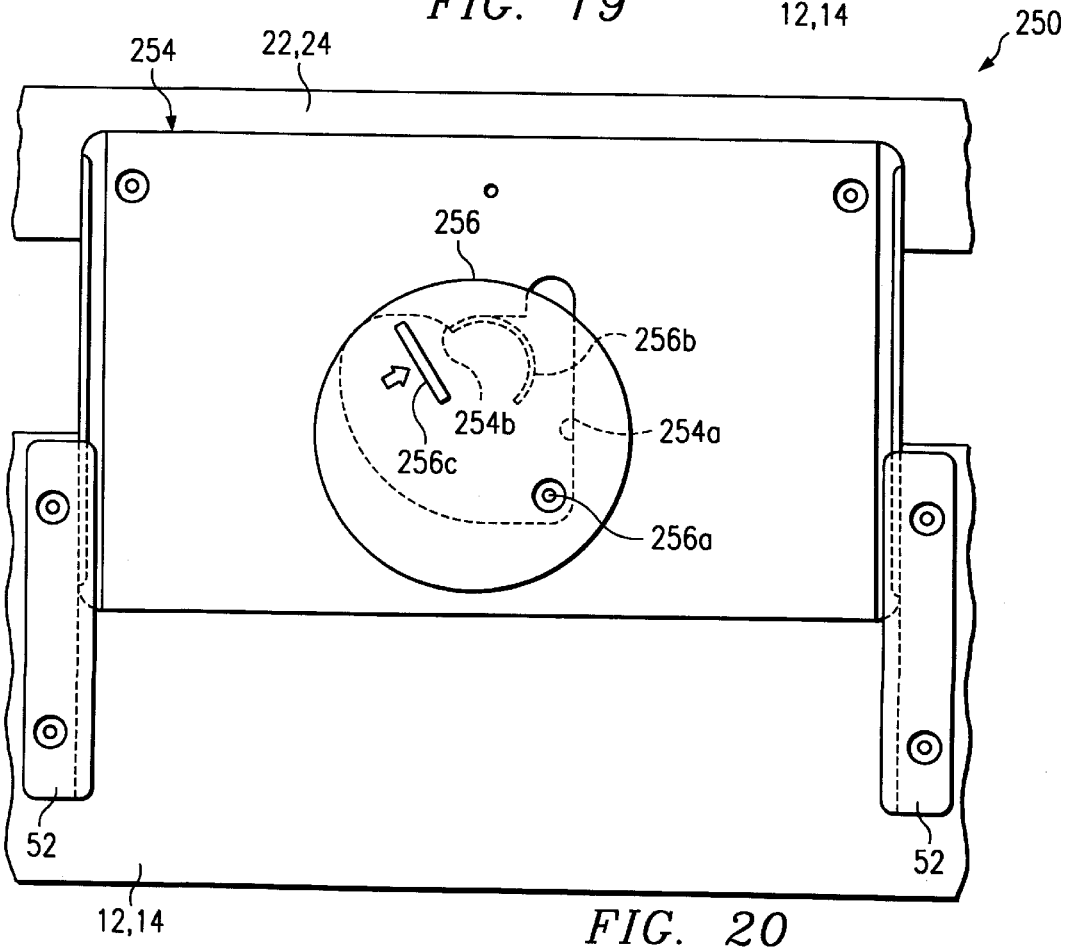
FIG. 20 is a front plan view of the bridge assembly of FIG. 19, showing it in the expanded state.

A bridge assembly 250 that is based on a cam latch, as shown in FIGS. 19 and 20, includes a modified bridge plate 254, which has a cam hole 254*a,* and a cam disc 256, which is pivotally attached by a screw 256*a* (or rivet) to the main frame wall panel 12, 14 and overlies the bridge plate 254. An arcuate cam follower rib 256*b* that protrudes from the back face of the cam disc 256 pushes the bridge plate 254 from the retracted state (FIG. 19) to the expanded state (FIG. 20) when a user manually rotates the cam disc 256 clockwise about the pivot screw 256*a*. A rib 256*c* on the front face of the cam disc 256 can be engaged by the user's fingers to facilitate rotating the cam disc. A ridge 254*b* in the cam hole 254*a* captures the cam follower rib 256*b* when the luggage item is in the expanded state. Attaining the expanded state requires a slight movement of the secondary unit to a position farther away from the main unit than the final expanded position.

What is claimed is:

1. An item of expandable luggage comprising a frame having a first substantially rigid component and a second substantially rigid component, each of which includes a pair of opposite rectangular peripheral wall panels that together with another pair of peripheral wall members form the peripheral boundary of a variable volume enclosure and a generally rectangular area, a peripherally continuous gusset of flexible material connected between the perimeter wall panels and peripheral wall members of the two frame components, and a bridge assembly joining each wall panel of the first component to a corresponding wall panel of the second component in coplanar relation and for linear displacement of the two components toward and away from each other, each bridge assembly including a pair of parallel spaced-apart slide rails affixed to the wall panel of the first component, a substantially rigid bridge plate affixed to the wall panel of the second component and slidably received by the slide rails, and a latch releasably latching the bridge plate to the wall panel of the first component in at least one position in which the second component is held spaced apart from the first component.

2. The item of luggage as claimed in claim 1, wherein the latch enables the bridge plate to be latched to the wall panel of the first component in a plurality of positions.

3. The item of luggage as claimed in claim 2, wherein the latch enables the bridge plate to be latched to the wall panel of the first component in an infinite number of positions.

4. The item of luggage as claimed in claim 3, wherein the latch includes a panel of loop material affixed to the bridge panel, a flexible band attached to the wall panel of the first component, and a strip of hook material affixed to the flexible band and releasably engageable with the loop material on the bridge plate.

5. The item of luggage as claimed in claim 1, wherein the latch includes a cam cutout in the bridge plate and a cam disc carried for rotation by the wall panel of the first component.

6. The item of luggage as claimed in claim 1, wherein the latch includes a resiliently biased catch button carried by the wall panel of the first component and an abutment edge on the bridge plate engageble by the catch button.

7. The item of luggage as claimed in claim 1, wherein each slide rail includes a body portion engaging the wall panel of the first component and a projecting flange portion defining with the wall panel of the first component a guide groove.

8. The item of luggage as claimed in claim 7, wherein the flange portion has a guide rib projecting toward the wall panel of the first component.

9. The item of luggage as claimed in claim 8, wherein the bridge plate has along opposite edges a guide groove receiving the guide rib on the flange portion of the slide rail.

10. An item of expandable luggage comprising a frame having a substantially rigid main frame component that includes a pair of opposite rectangular planar main wall panels forming together with a pair of wall members the peripheral boundary of a larger main volume and a rectangular area and a substantially rigid secondary frame component that includes a pair of opposite rectangular planar secondary wall panels forming together with a pair of wall members the peripheral boundary of a smaller secondary volume and a rectangular area that is the same in size and shape as that formed by the wall panels and wall members of the main frame component;

a peripherally continuous gusset of flexible material connected between the wall panels and wall members of the main frame component and the wall panels sand wall members of the secondary frame component; and a bridge assembly joining each wall panel of the main frame component to a corresponding wall panel of the secondary frame component in coplanar relation and for linear displacement of the secondary frame component toward and away from the main frame component, each bridge assembly including a pair of parallel spaced-apart slide rails affixed to the wall panel of the main frame component, a substantially rigid bridge plate affixed to the wall panel of the secondary frame component and slidably received by the slide rails, and a latch releasably latching the bridge plate to the wall panel of the main frame component in at least one position in which the secondary frame component is spaced apart from the main frame component such that the luggage item has a total volume substantially greater than the total of the main volume and the secondary volume.

11. The item of luggage as claimed in claim 10, wherein the latch enables the bridge plate to be latched to the wall panel of the main frame component in a plurality of positions.

12. The item of luggage as claimed in claim 11, wherein the latch enables the bridge plate to be latched to the wall panel of the main frame component in an infinite number of positions.

13. The item of luggage as claimed in claim 12, wherein the latch includes a panel of loop material affixed to the bridge panel, a flexible band attached to the wall panel of the main frame component, and a strip of hook material affixed to the flexible band and releasably engageable with the loop material on the bridge plate.

14. The item of luggage as claimed in claim 10, wherein the latch includes a cam cutout in the bridge plate and a cam disc carried for rotation by the wall panel of the main frame component.

15. The item of luggage as claimed in claim 10, wherein the latch includes a resiliently biased catch button carried by the wall panel of the main frame component and an abutment edge on the bridge plate engageble by the catch button.

16. The item of luggage as claimed in claim 10, wherein each slide rail includes a body portion engaging the wall panel of the main frame component and a projecting flange portion defining with the wall panel of the main frame component a guide groove.

17. The item of luggage as claimed in claim 16, wherein the flange portion has a guide rib projecting toward the wall panel of the main frame component.

18. The item of luggage as claimed in claim 17, wherein the bridge plate has along opposite edges a guide groove receiving the guide rib on the flange portion of the slide rail.

* * * * *

UNITED STATES PATENT AND TRADEMARK OFFICE

CERTIFICATE OF CORRECTION

PATENT NO. : 6,220,411 B1
DATED : April 24, 2001
INVENTOR(S) : Scicluna et al.

It is certified that error appears in the above-identified patent and that said Letters Patent is hereby corrected as shown below:

Title page,
Item [56], References Cited, FOREIGN PATENT DOCUMENTS, insert -- 0002026 9/2000 (AT) --

Column 1,
Line 32, “duffle” should read -- duffel --

Column 6,
Line 52, “engageble” should read -- engageable --

Column 7,
Line 12, “sand” should read -- and --

Column 8,
Line 20, “engageble” should read -- engageable --

Signed and Sealed this

Fourth Day of March, 2003

JAMES E. ROGAN
*Director of the United States Patent and Trademark Office*